US006065745A

United States Patent [19]

Casper et al.

[11] Patent Number: 6,065,745

[45] Date of Patent: May 23, 2000

[54] CRADLE FOR FEEDING OF NON-UNIFORM SHEETS IN A PRINTER OR COPIER

[75] Inventors: Mark Casper, Williamsville; Dan Shenk, Niagara Falls, both of N.Y.

[73] Assignee: Moore U.S.A. Inc., Grand Island, N.Y.

[21] Appl. No.: 09/084,453

[22] Filed: May 26, 1998

[51] Int. Cl.[7] ..... B65H 1/10

[52] U.S. Cl. ..... 271/160; 271/22; 271/24; 271/30.1; 221/279

[58] Field of Search ..... 271/160, 22, 24, 271/30.1; 221/279

[56] References Cited

U.S. PATENT DOCUMENTS 2,471,066 6/1949 Hesson ..... 271/62
2,886,314 5/1959 Phelan .
4,593,895 6/1986 Myers et al. ..... 271/148
4,942,435 7/1990 Kneisel et al. ..... 355/311

*Primary Examiner*—Christopher P. Ellis
*Assistant Examiner*—Richard Ridley
*Attorney, Agent, or Firm*—Simpson, Simpson & Snyder

[57] ABSTRACT

A cradle for holding and feeding a stack of sheets in a printer or copier which compensates for non-uniformities in the stack, and especially non-uniformities in the central portion of the stack, thereby presenting a level top sheet to a sheet feeder regardless of how many sheets are in the stack. The cradle broadly comprises a rectangular base plate and four support posts arranged proximate the corners of the base plate. Two extension springs are arranged diametrically with respect to one another, each spring supported at its ends by the support posts, with the springs intersecting one another at approximately the center of the base plate. The extension springs support a plastic sheet, upon which the stack of sheets is laid.

5 Claims, 3 Drawing Sheets

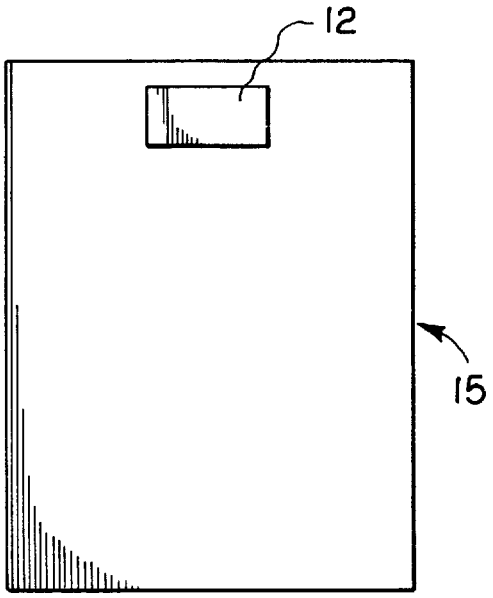
FIG. 1
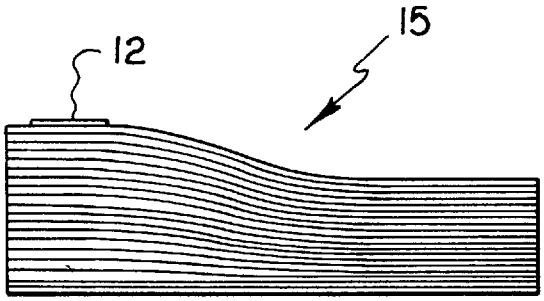
FIG. 2
FIG. 3
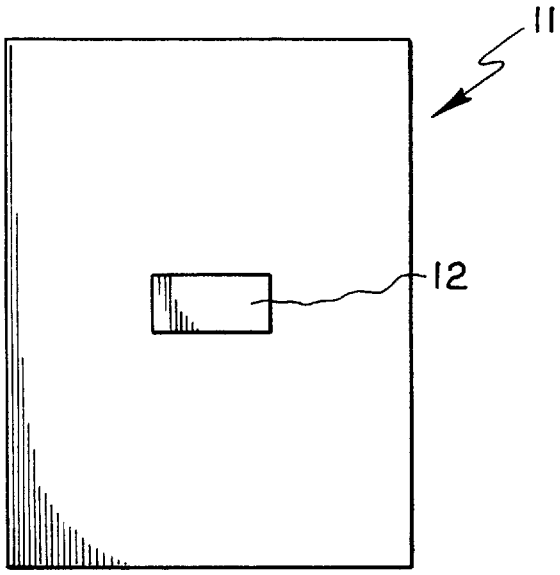
FIG. 4
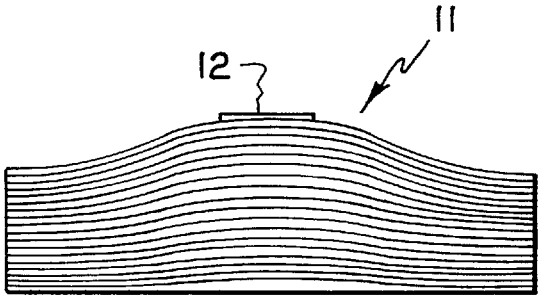

CRADLE FOR FEEDING OF NON-UNIFORM SHEETS IN A PRINTER OR COPIER

FIELD OF THE INVENTION

This invention relates generally to printers and copiers and, more specifically, to a cradle for sheet feeding and leveling non-uniform sheets in printers and copiers, and, even more specifically, to a cradle which compensates for non-uniformities in a center of a stack of sheets.

BACKGROUND OF THE INVENTION

In many laser and dot matrix printers, and in photostatic copiers, large volumes of paper sheets are fed from a storage tray to the transfer station of the machine where the printing or copying is done. Frequently a stack of sheets is stored in a sheet feeding tray, which is spring loaded or motor driven to cause successive sheets to advance upwardly. Mounted proximate the top of the stack of sheets is a sheet feeder, usually a conveyor or other roller device which grabs the top most sheet in the stack and transfers it into the machine.

Unfortunately, the stack of sheets is often non-uniform in thickness due to the nature of the sheets. For example, sheets containing adhesive labels can be non-uniform in thickness. Even plain paper sheets can be non-uniform in thickness. The sheet feeder in these machines expects to see a flat, uniform stack of sheets. A non-uniform stack causes feed jams, or triggers a false indication of an empty hopper.

Various attempts have been made for leveling sheets. U.S. Pat. No. 2,471,066 (Hesson) discloses a compensator mechanism for uneven thickness sheet feeding for use on a can labeler. A hinged section moves up or down to maintain the top of the stack level. U.S. Pat. No. 2,886,314 (Phelan) discloses a compensator mechanism for uneven thicknesses of paper. The mechanism uses a pair of compensator bars for raising the middle as well as one end of the stack to level the top. U.S. Pat. No. 4,593,895 (Myers et al.) discloses a cash dispensing machine cassette having a stack of bills with their long lower edges supported on a floor when loaded in the cassette. A pair of resilient pushers engage the rear of the stack of bills to slide the bills into operative engagement with an ATM which discharges bills therefrom. U.S. Pat. No. 4,942,435 (Kneisel et al.) discloses an apparatus adapted to be mounted on a tray for supporting a stack of sheets having one marginal region of the stack thicker than other marginal regions.

While others have focused primarily on compensating for non-uniformities at the margins of sheets, a need still exists for a simple and inexpensive means of compensating for non-uniformities which exist in the middle or center of the sheet.

SUMMARY OF THE INVENTION

The present invention broadly comprises a cradle for holding and feeding a stack of sheets in a printer, including a rectangular base plate having four comers, four support posts fixedly secured to and extending upwardly from the base plate, each of the support posts located proximate one of the comers, a first extension spring having a first end and a second end, the first end attached to a first of the support posts and the second end attached to a second of the support posts positioned diagonally thereto, and, a second extension spring having a first end and a second end, the first end attached to a third of the support posts and the second end attached to a fourth of the support posts positioned diagonally thereto, wherein the first and second extension springs intersect one another and are arranged to support and hold the stack of sheets.

A primary object of the present invention is to provide a cradle for holding and feeding a stack of sheets in a printer or copier which compensates for non-uniformities in the stack, especially non-uniformities in the central portion of the stack, and functions to present a level top sheet to a sheet feeder regardless of how many sheets are in the stack.

Another object of the invention is to provide a cradle which is suitable for use in a variety of printers and copiers, and with a variety of paper sizes and thicknesses.

These and other objects, features and advantages of the present invention will become readily apparent to those having ordinary skill in the art upon a reading of the specification and claims in view of the drawings.

BRIEF DESCRIPTION OF THE DRAWINGS

FIG. 1 is a top plan view of a representative stack of sheets having a non-uniform thickness in a marginal region thereof, FIG. 2 is a side view of the stack of sheets shown in FIG. 1;

FIG. 3 is a top plan view of a representative stack of sheets having a non-uniform thickness in the center region thereof, FIG. 4 is a side view of the stack of sheets shown in FIG. 3;

DETAILED DESCRIPTION OF THE PREFERRED EMBODIMENT

Figure 5:
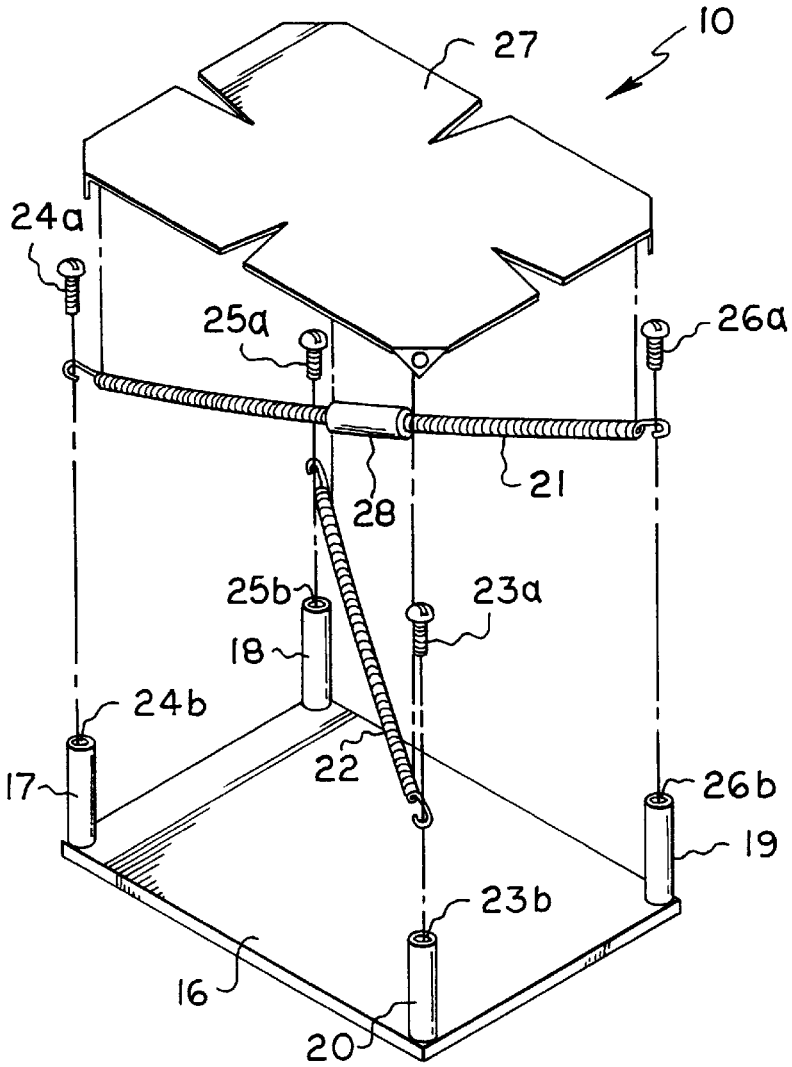
FIG. 5 is an exploded perspective view of the cradle of the invention.

At the outset, it should be understood that like reference numerals on different drawing figures refer to identical structural elements of the invention. It should also be understood that, although the following description is of a preferred embodiment of the invention, modifications and changes can be made without departing from the spirit and scope of the invention as claimed. It should also be understood that the print cradle of the present invention is intended for use in a variety of machines, including printers and copiers, and, in fact, any machine which feeds paper meets from a stack. The present invention as described is ideally suitable for compensating for non-uniformities in a stack of sheets, where the non-uniformity occurs in the central portion of the stack (e.g., the stack is thicker in the center than at the periphery or margins). However, the invention also compensates for non-uniformities in other areas of the stack. The cradle dimensions can vary depending upon the size of the sheets being held. For example, the cradle can be slightly smaller than 8½ by 11 inches to fit a printer hopper which holds paper of size 8½ by 11 inches, or the cradle can be appropriately sized for A4 or A5 paper.

Adverting now to the drawings, FIG. 1 illustrates in top plan view a stack 15 of sheets having a non-uniform thickness. Plastic marker 12 is situated at a marginal end of the stack. As shown in FIG. 2, which is a side view of the stack shown in FIG. 1, marker 12 is located at a thicker section of the stack. This is a common non-uniformity and exists, for example, in stacks which contain holes punched in one side and contain reinforcement strips along the hole-punched sides. Others have attempted to compensate for this type of non-uniformity problem.

FIG. 3, on the other hand, illustrates a stack 11 of sheets in a top plan view, where the stack has a non-uniformity in the center of the stack as illustrated by the placement of marker 12 (proximate the center of the stack), as shown more clearly in side view in FIG. 4.

The cradle 10 of the present invention is illustrated in perspective exploded view in FIG. 5. The cradle includes a base plate 16 which, in a preferred embodiment is rectangular in shape and therefore contains four corners. Mounted proximate the four corners are four support posts which extend upwardly from the base plate and are fixedly secured thereto. As shown in FIG. 5, first support post 17, second support post 18, third support post 19 and fourth support post 20 all extend upwardly from base plate 16. These support posts all contain threaded partial through-bores 24*b*, 25*b*, 26*b* and 23*b*, respectively.

A first end of first extension spring 21 is secured to first support post 17 by screw 24*a* which engages threaded partial through-bore 24*b*. This spring extends diagonally across the base plate and a second end of the spring is secured to third support post 19 by screw 26*a* which engages threaded partial through-bore 26*b*. Similarly, a first end of second extension spring 22 is secured to second support post 18 by screw 25*a* which engages threaded partial through-bore 25*b*. This spring extends diagonally across the base plate and a second end of the spring is secured to fourth support post 20 by screw 23*a* which engages threaded partial through-bore 23*b*. Obviously, the springs could be secured to the support posts in a variety of ways. The springs are free (i.e., are not connected to one another) at their intersection. To ensure that a crown always exists in sheet 27. especially when there are only a few sheets in a stack being supported, collar 28 is secured about upper spring 21 at the point of intersection with spring 22. In a preferred embodiment, it has been found that springs having a spring constant of approximately 0.3 to 0.8 lbs./inch are suitable for leveling a standard stack of sheets. A typical stack may vary in size from 1 to 1000 sheets, and from 0.01" to 11" in height.

Figure 6:
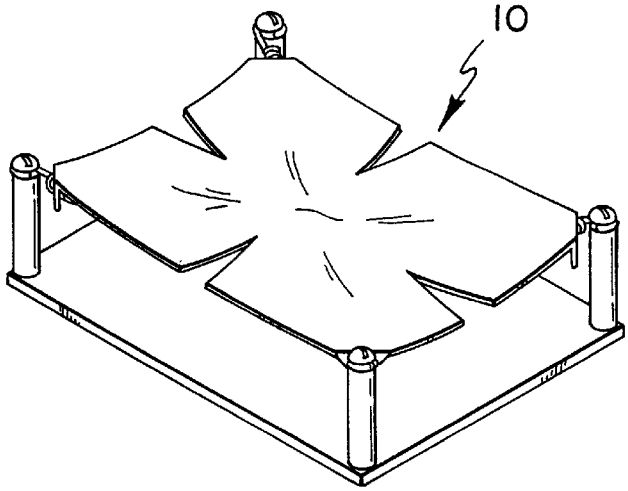
FIG. 6 is a perspective view of the assembled cradle of the invention.

A plastic sheet 27 is fixedly secured to the ends of the springs and is therefore free to move with the springs. As shown in FIGS. 5 and 6, "V" cuts are made in the sides of sheet 27 to enhance flexibility of the sheet. The sheet may be secured to the springs in any suitable manner. For example, holes may be punched in the comers of the sheet and the hooks at the ends of the springs may be passed through these holes. In a preferred embodiment, sheet 27 may be made of polyacetal and be approximately 0.01" to 0.03" in thickness.

Figure 7:
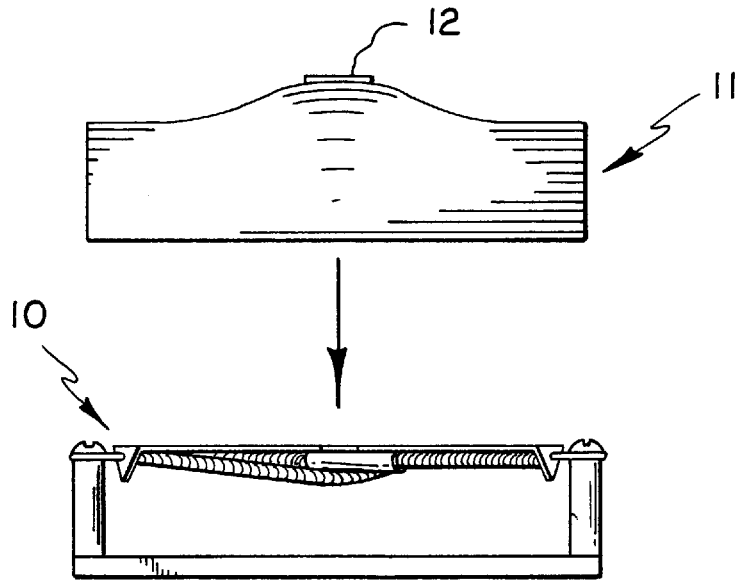
FIG. 7 is a side view of the cradle of the invention taken just prior to a non-uniform stack of sheets being placed therein; and, FIG. 8 is a view similar to that of FIG. 7 taken after the stack of non-uniform sheets has been placed in the cradle, and illustrating how the cradle functions to present a level top sheet to the sheet feeder.
Figure 8:
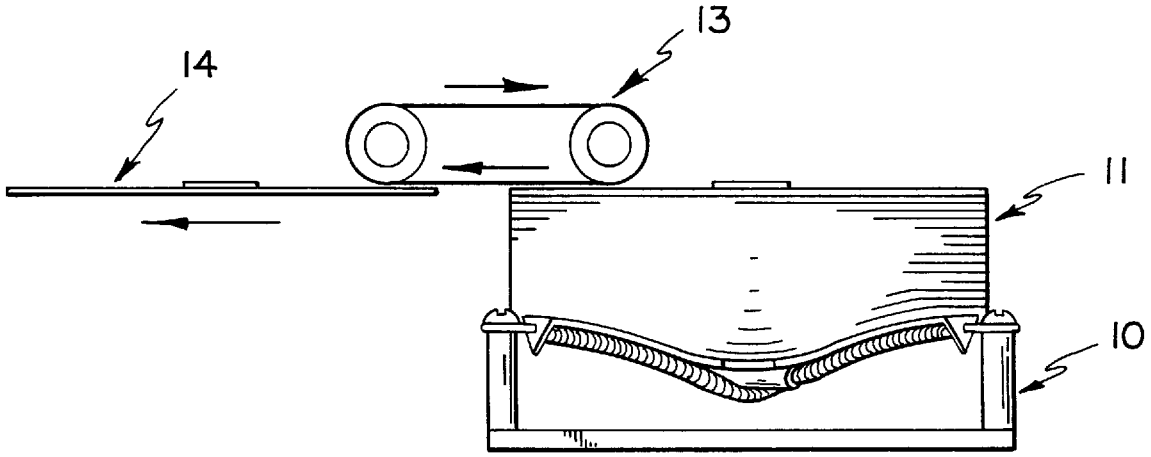

The cradle of the invention is shown fully assembled in perspective view in FIG. 6. Operation of the invention is illustrated in FIGS. 7 and 8. In FIG. 7, a stack 11 having a thickness non-uniformity in the center thereof is being placed upon cradle 10. As shown in FIG. 8, once the stack is placed on the cradle, the springs give (sag) causing the stack to present level top sheets to feed mechanism 13 while maintaining a crown 29 in the stack at all times. The feed mechanism is then able to feed sheet 14 from the top of the stack.

Thus, it is seen that the objects of the invention are efficiently obtained, although those having ordinary skill in the art can readily recognize simple modifications which may be made to the preferred embodiment of the invention as described without departing from the scope or spirit of the appended claims.

What we claim is:

1. A cradle for holding and feeding a stack of sheets in a printer, comprising:

a rectangular base plate having four corners;

four support posts fixedly secured to and extending upwardly from said base plate, each of said support posts located proximate one of said corners;

a first extension spring having a first end and a second end, said first end attached to a first of said support posts and said second end attached to a second of said support posts positioned diagonally thereto; and, a second extension spring having a first end and a second end, said first end attached to a third of said support posts and said second end attached to a fourth of said support posts positioned diagonally thereto, wherein said first and second extension springs intersect one another and are arranged to support and hold said tack of sheets.

2. The cradle of claim 1, further comprising a rectangular plastic sheet fixedly secured to said first and second extension springs and operatively arranged to support and hold said stack of sheets.

3. The cradle of claim 2 wherein said plastic sheet is comprised of polyacetal of approximately 0.1"–0.03" in thickness.

4. The cradle of claim 1 wherein each of said extension springs has a spring constant in the range of approximately 0.30 lbs./inch to 0.80 lbs./inch.

5. The cradle of claim 1 wherein said first extension spring intersects said second extension spring atop said second spring, and further comprising a shaft collar surrounding said first extension spring at its approximate midpoint, said collar operatively arranged to maintain a crown in said stack at all times.

* * * * *